US006097112A

United States Patent [19]

Kondo

[11] Patent Number: 6,097,112

[45] Date of Patent: Aug. 1, 2000

[54] ELECTRONIC ON/OFF SWITCH FOR REMOTE CONTROL MODEL PROTECTED FROM INADVERTENT TURN-OFF OF ITS RECEIVER

[75] Inventor: Hirotoshi Kondo, Tokyo, Japan

[73] Assignee: Kondo kagaku Co., Ltd., Tokyo, Japan

[21] Appl. No.: 09/016,819

[22] Filed: Jan. 30, 1998

[30] Foreign Application Priority Data

Sep. 29, 1997 [JP] Japan ..... 9-279361

[51] Int. Cl.[7] ..... A63H 17/385

[52] U.S. Cl. ..... 307/125; 307/141; 446/154; 446/454; 446/456; 701/2

[58] Field of Search ..... 307/9.1–10.7, 307/112, 125, 150, 130, 131, 134, 139, 140, 141, 141.4, 142; 361/194; 701/2; 446/154, 454, 456; 320/112, 124, 134, 152

[56] References Cited

U.S. PATENT DOCUMENTS 4,689,492 8/1987 Petevil ..... 307/142

5,334,075 8/1994 Kakizaki et al. ..... 446/456

5,521,443 5/1996 Imura et al. ..... 307/10.2

*Primary Examiner*—Albert W. Paladini

*Attorney, Agent, or Firm*—Dilworth & Barrese

[57] ABSTRACT

This invention provides an electronic switch for model cars to prevent incapability of the remote operation of the model cars.

Keeping the manual switch 10 for a given period at ON state, a receiver 4 and a battery 5 are connected, and after a provisional OFF state of a manual switch 10, it is reset in ON state for a given period, to disconnect an electrical connection between the receiver 4 and the battery 5. For this sake, even if the manual switch 10 is abruptly changed over to OFF state upon abut to an obstacle during a run of the model car, the electrical connection between the receiver 4 and the battery 5 is not disconnected, as far as a given period continuation of the OFF state of the manual switch. With a use of the switching circuit 13, ON/OFF change over is provided without using a mechanical contact, which provides no anxiety of the disconnect of contact caused by the vibration.

7 Claims, 8 Drawing Sheets

ELECTRONIC ON/OFF SWITCH FOR REMOTE CONTROL MODEL PROTECTED FROM INADVERTENT TURN-OFF OF ITS RECEIVER

BACKGROUND OF THE INVENTION

1. Field of the Invention

This invention relates to an electronic switch means for models, and more particularly an electronic switch means for models for use, to change-over an electric connection between a receiver and a battery mounted on the model main body such as a model car from ON (connection)/OFF (non-connection).

Here, the battery includes all batteries such as an Ni battery, dry battery and similar battery having said object.

2. Description of the Prior Art

FIG. 8 shows a perspective view of conventional a mechanical switch for a model.

The prior art mechanical switch 30 is connected via conductor wire 33 between a battery 31 and a receiver 32, which maintains electrical connection between the battery 31 and the receiver 32 by translating a knob 30*a* in an arrow A direction, while translating the knob 30*a* in an arrow B direction, to disconnect an electrical connection between the battery 31 and the receiver 32.

Hence, for example to operate the model car, a user closes the mechanical switch 30 ON to keep the electrical connection between the bay and the receiver 32, and upon receipt of an operation signal from a transfuser by the receiver 32 which issues a signal to actuate an actuator (not shown) to controllably operate car speed and operation of the model car.

When the user does not operate the model car, he translates the knob 30*a* of the mechanical switch 30 to open the mechanical switch 30 OFF to disconnect the electrical connection between the battery 31 and the receiver 32.

To this end, in the conventional mechanical switch 30, there is a case such that the knob 30*a* of the mechanical switch mounted on the model car abuts an obstacle to change over to OFF during a run of the model car. In this case, the user cannot conduct a remote operation immediately at the OFF state, for an electrical disconnection between the battery 31 and the receiver 32.

Then, as the mechanical switch 30 maintains ON state by a contact of the mechanical contact, the mechanical switch 30 contact is apart against the operator's will, by a vibration during a run of the model car, which sets the mechanical switch 30 in OFF state.

In such a case the operator cannot remotely operate the model car immediately at the OFF state.

Additionally, when the battery 31 is charged the operator much manually change over the mechanical switch 30 preliminary to OFF state, which causes a troublesome action, to protect the receiver 32 from over current.

SUMMARY OF THE INVENTION

This invention provides an electronic switch means for model car to prevent an incapability of the remote operation from a switch malfunction and provides an easy charging operation, to improve operation, to overcome all the drawbacks.

To achieve said object of the present invention, a primary object of this invention is to provide an electronic switch means which changes over the electric connection between the receiver to receive signals from the transmitter thereby applying operation signals to the actuator of the model main body, and the battery to apply a voltage to this receiver, to ON/OFF state, said means having a manual switch to be set in ON by depressing an operation button and in OFF state by releasing (further depressing) the operation button depress, electrically connecting the receiver and the battery by closing the switch circuit in ON state, subject to maintenance of the manual switch in ON state for a given period by depressing this operation button, releasing the depress of the operation button to convert back the manual switch in OFF state, then keep the switching circuit in OFF state to disconnect the electrical connection between the receiver and the battery, subject to maintenance of the manual switch to reset in OFF state for a given period.

In the electronic switch means for model car, according to said invention, the manual switch is kept in ON state for a given period, to change over the receiver and the battery into an electronically connected state, then the manual switch to OFF state, again the manual switch in ON state for a given period, so as to disconnect the electronical connection between the receiver and the battery, to keep the electronic switch means in ON state.

Accordingly, for example in a case of abutment of the manual switch during the model car ran, to instantaneous change over the manual switch into ON state, there is no anxiety of disconnection of the electrical connection between the receiver and the battery as far as its ON state is manned. As it is possible to change over the ON/OFF of the electrical connection between the receiver and the battery, without using a mechanical contact, there is no anxiety of disconnection of the electrical connection between the receiver and the battery from an influence of vibration emitted from the running model car.

The invention is also characterized in that it includes a voltage and current detecting circuit to detect charging current and voltage rise state of the battery caused by charging, signals from the voltage and current detecting circuit causing the switch circuit to be switched over into OFF.

Here, as the switching circuit can be automatically changed over into OFF state, based on the signals from the voltage and current detecting circuit, there is no anxiety of flow the over current during charging into the receiver. In other words, there is no need of the change over by the manual switch for charging the battery.

The invention is also characterized in that said voltage current detecting circuit detects a voltage drop state and the detection signal is transmitted to a display means which shows the voltage drop state of the battery.

The user can easily judge the charging time and exchanging time of the battery, as the voltage drop state of the battery drop state is shown on the display means.

BRIEF DESCRIPTION OF THE ACCOMPANYING DRAWINGS

DESCRIPTION OF THE PREFERRED EMBODIMENTS

Figure 1:
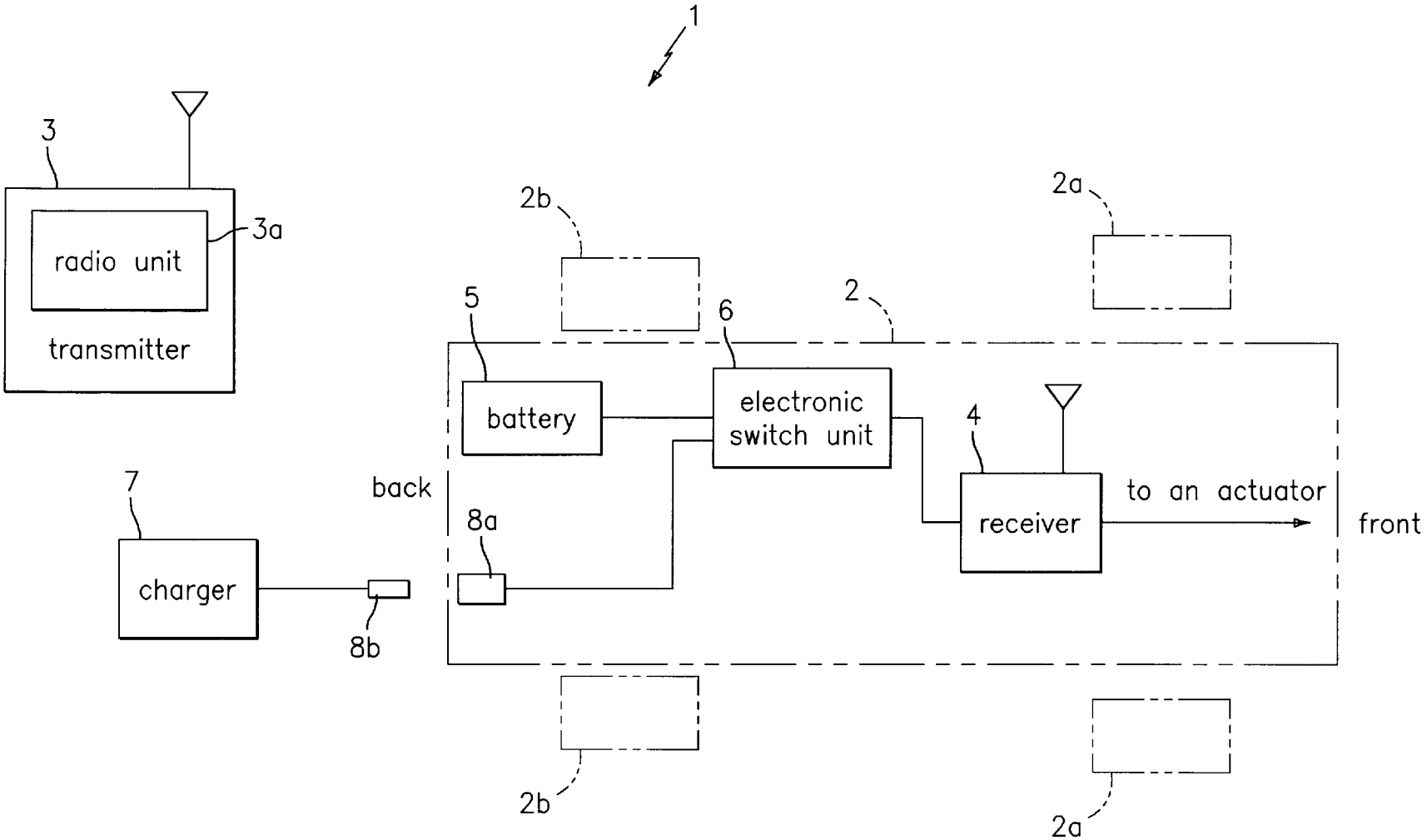
FIG. 1 is a block diagram of a remote operation device employing an electronic switch means for a model car according to this invention.

As shown in FIG. 1, a remote operation device 1 comprises a transmitter 3 to transmit signals to operate a model car 2, a receiver 4 to receive the signals from the transmitters and to apply operation signals to an actuator (not shown) of the model car 2, a battery 5 to apply a voltage to this receiver 4, and an electronic switch means 6 for the model car to change over an electric connection between this battery 5 and the receiver 4 into ON (connection)/OFF (disconnection) states. In the FIG. 1, reference numeral 7 denotes a charger to charge the battery. The model car 2 is mounted with the receiver 4, the battery 5 and the electronic switch unit 6 and front wheels 2*a*, 2*a*, and rear wheels 2*b*, 2*b*. Numeral 3*a* denotes a radio unit set on the transmitter numeral, 8*a* denotes a female connector connected to the electronic switch means 6, and numeral 8*b* denotes a male connector connected to the charger 7.

Figure 2:
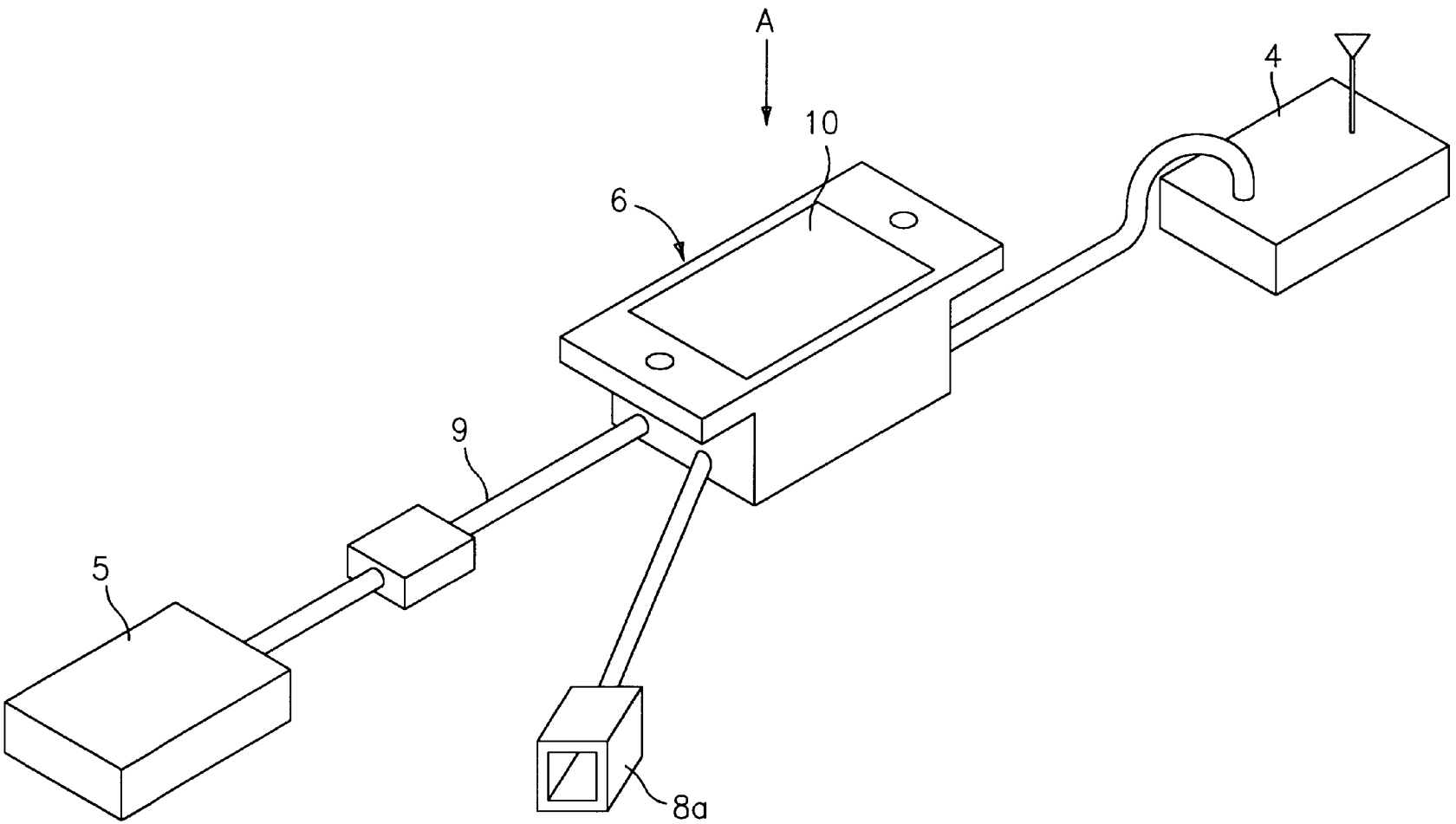
FIG. 2 is a perspective view of the electronic switch means according to this invention.

As shown in FIG. 2, the electronic switch means 6 is connected between the receiver 4 and the battery 5 through a conductor wire 9, and upon depress of the operating button of the manual switch 10 in an arrow A direction (not mechanical translation but reserving an electronic connection state), the manual switch 10 is changed over from OFF state to ON state whereby are stop of the push button depress changes over the manual switch from ON state to OFF state.

The electrical connection between the receiver 4 and the battery 5 is changed over from OFF state to ON state, subject to maintaining of ON state of the manual switch for a given period.

As this manual switch 10 is a manual operation auto return switch, upon release of the depress force toward the operation button, the operation button is returned by a return spring (not shown), the manual switch 10 is changed over automatically to OFF state, but the electronical connection between the receiver 4 and the battery 5 is not released to keep ON state, even if the manual switch is changed over to OFF state.

The manual switch 10 is reset to ON state with re-depress of the operating button of the manual switch 10, and the electrical connection between the receiver 4 and the battery 5 is released subject to a given period ON state connection.

Here, as the manual switch 10 of this invention is different from the conventional mechanical switch and does not need a member to slide diametrically, and then does not need a projection part which is seen in the mechanical switch. For this reason, there is no anxiety of abutment of the projection part of the switch to an obstacle which causes an abrupt ON/OFF change over of the manual switch 10.

Figure 3:
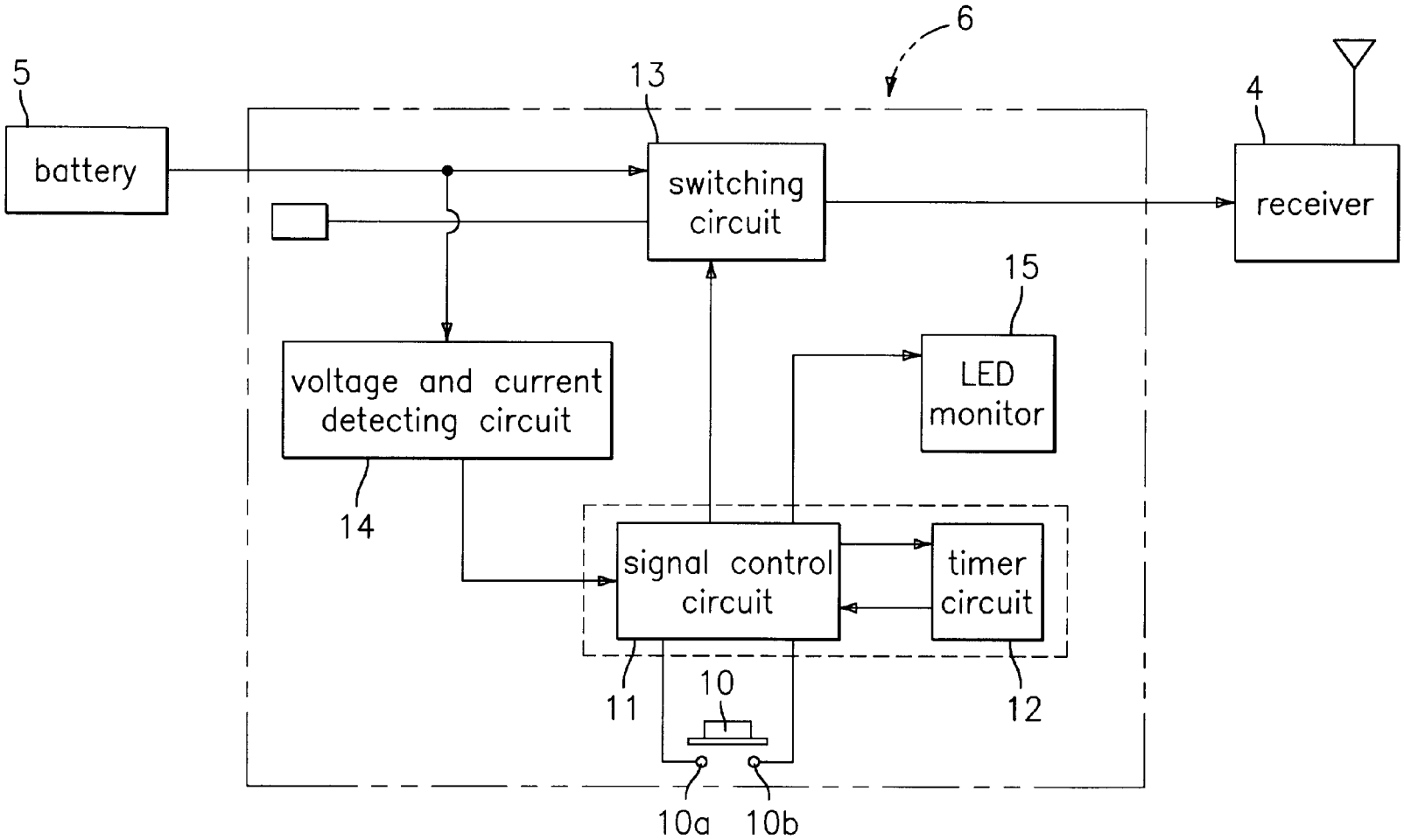
FIG. 3 is a block diagram of the electronic switch means according to this invention.

As shown in FIG. 3, the electronic switch means 6 comprises a manual switch 10 of auto return type of the operation button, a signal control circuit 11 to generate signals when a terminals 10*a* and 10*b* is connected, a timer circuit 12 to generate output signals after a given period from receipt of the signals from said signal control circuit 11, a switching circuit 13 to change over the electrical connection between the receiver 4 and battery 5 to ON state, based on the output signals from said timer circuit 12, a voltage and current detecting circuit 14 coupled to a charging current from a charger 7 (shown in FIG. 1) to detect a voltage rise state of the battery 5 when charged to transfer cut signals to said signal control circuit 11, and LED (light emission diode) monitor 15 to show the voltage drop state of the battery detected by the voltage and rent detecting circuit 14.

To this end, said timer circuit 12 is arrangable to be provided independently from said signal control circuit 11, and integrally built in the signal control circuit.

The switching circuit 13 is a circuit constituted to change over ON/OFF state by an aid of a semiconductor element. Accordingly, as the switching circuit 13 has no mechanical contact for change over of ON/OFF state, there is no risk of separating the contact of the switching circuit 13 by vibration of the model car thereby to unwillingly release the electric connection between the receiver 4 and the battery 5.

Now, a function of the electronic switch means 6 for the model car according to this invention will be discussed.

The contacts 10*a* and 10*b* are contacted by a depress of the operating button of the manual switch 10 shown in FIG. 3, to transmit an ON signal from the signal control circuit 11 to the timer circuit 12. With a depress of the operation button of the manual switch 10 for a given period (for example 2 seconds) the ON signal is consecutively transmitted from the signal control circuit 11 to the timer circuit 12 which generates an ON output signal. When this ON output signal is transmitted to the switching circuit 13 via the signal control circuit 11, the switching circuit 13 is changed over into ON state, which causes the electric connection between the receiver 4 and the battery to be in ON state.

On the other hand, in a case to disconnect the electric connection between the receiver 4 and the battery 5, re-depress of the operation button of the manual switch 10 causes the timer circuit 12 to generate an OFF output signal which changes over the switching circuit 13 into OFF state thereby disconnecting the electric connection between the receiver 4 and the battery 5.

Now, a case to remotely operate the model car 2 by a radio unit 3*a* will be discussed.

As discussed above, a signal to operate the model car 2 is transmitted from the radio unit 3*a* to the receiver by operating the transmitter 3 shown in FIG. 1 after setting the electrical connection between the receiver 4 and the battery 5 in ON state. The receiver 4 receives the signal from the transmitter 3 to output an operation signal to the actuator on the model car 2, which permits to controllably operate the model car 2.

In the electronic switch means 6 shown in FIG. 3, it is arranged to change over the switching circuit 13 in ON state, after a maintenance of ON state with consecutive period depress of the operation button of the manual switch 10.

For this reason, there is no risk to set the switching circuit 13 in OFF state unwilling to the operator, since there is no given period succession of an instantaneous ON state of the operation button of the manual switch.

As the electric connection between the receiver 4 and the battery 5 is not disconnected for this reason, there is no risk of incapability of a remote operation of the model car 2 by the transmitter 3 when remote operating the model car 2 by the transmitter 3.

When the voltage of the battery 5 lowers during operation of the model car 2, the voltage and current detecting circuit 14 shown in FIG. 3 detects a voltage drop state to transmit the voltage drop signal to the signal control circuit 11. Upon a transmission of the voltage drop signal from said signal control circuit 11 to the LED monitor 15, the LED monitor 15 illuminates which permits the operator to confirm the voltage drop of the battery 5, and easily manage the battery.

Now, a case wherein a charging of the electronic switch means for the model car in accordance with this invention will be discussed with reference to the FIGS. 4 and 5.

Figure 4:
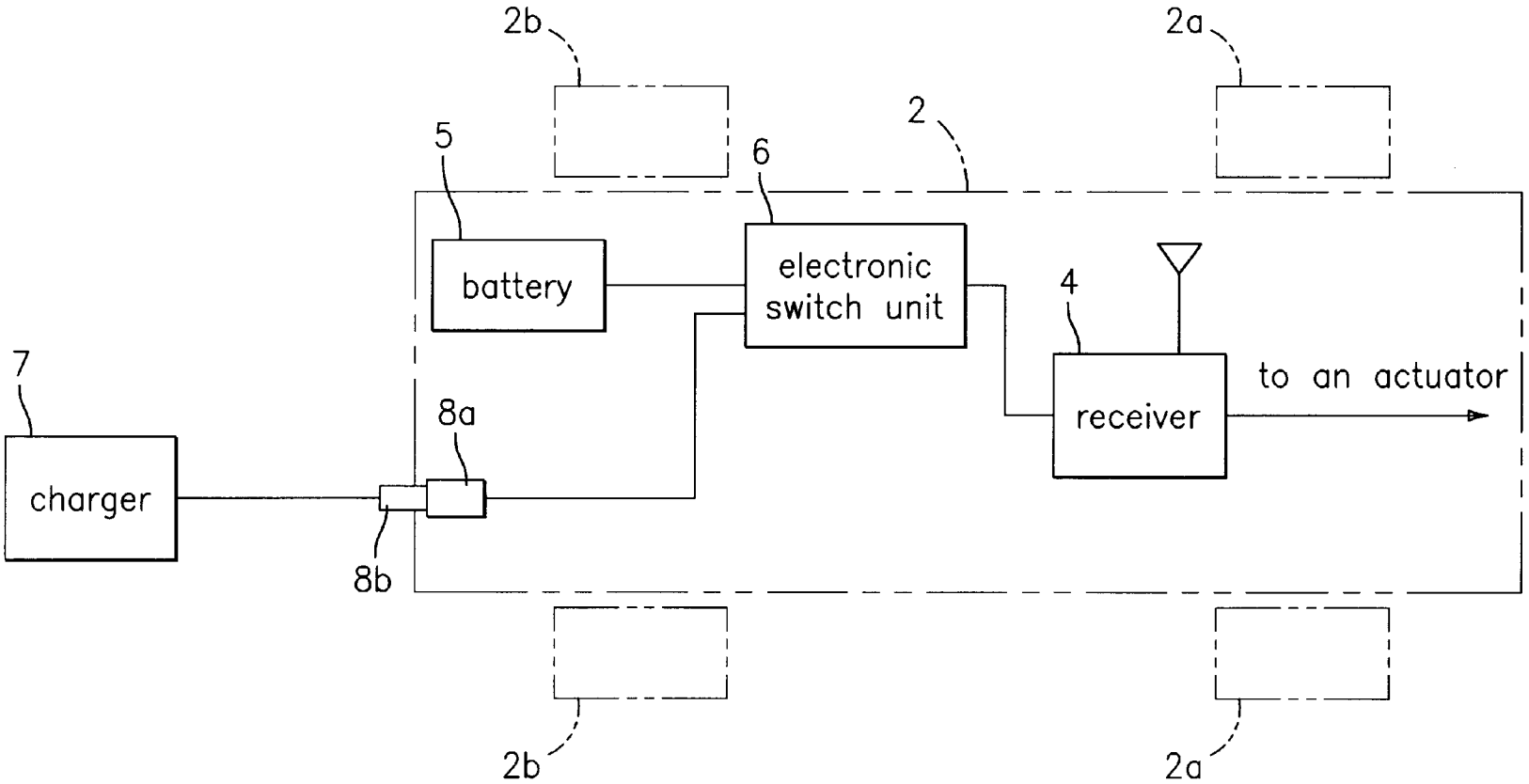
FIG. 4 is a block diagram showing a charging state of the remote operation device employing the electronic switch means for the model according to this invention.

As shown in FIG. 4, a male connector 8*b* of the charger 7 is connected to a female connector 8*a* connected to the electronic switch means 6.

Figure 5:
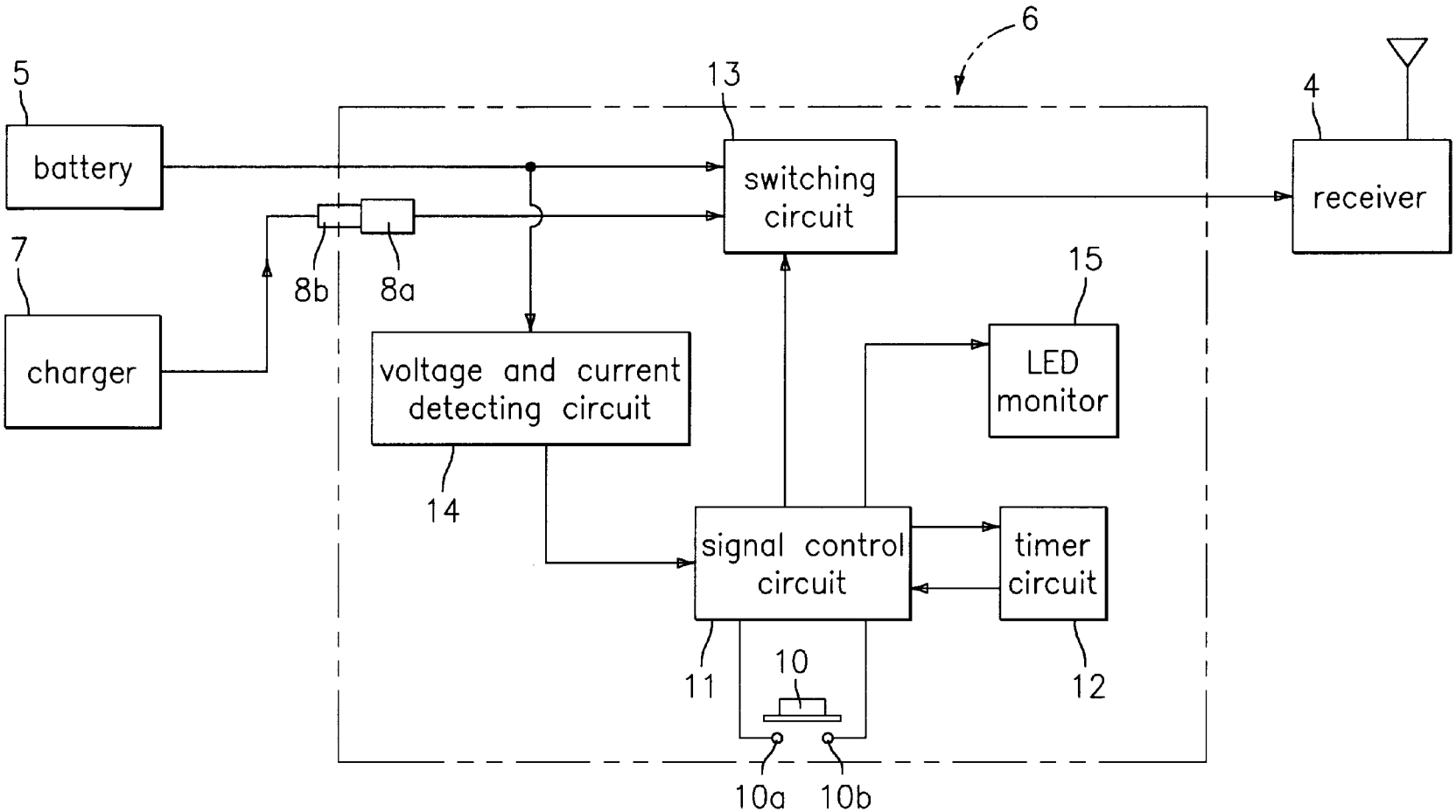
FIG. 5 is a block diagram showing a charging state of the electronic switch means for the model according to this invention.

By this means, the charger 7 is electrically connected to the battery 5 via the switching circuit 13 whereby charging of the battery 5 is started in an order shown in a narrow mark in FIG. 5.

At this time, the voltage and current detecting circuit 14 detects a charging current from the charger 7 and a voltage rise at the charging, and transmits a cut signal to the signal control circuit 11.

As the signal control circuit 11 feeds an OFF signal to the switching circuit 13 based on this cut signal, the switching circuit 13 is automatically changed over to OFF state, which causes the electric connection between the receiver 4 and the battery 5 to be disconnected.

For this fact an over current during the charging does not flow into the receiver 4.

Now, a case of remote operate the model car according to this invention by a wired device will be discussed with reference to FIGS. 6 and 7.

First, the radio unit 3*a* (FIG. 1) is dismounted from the transmitter 3 on to which the wired unit 3*b* is set.

Then, a male connector 8*c* of the wired unit 3*b* is connected to a female connector 8*a* connected to the electronic switch means 6. Then, a continuous given period depress of the operation button of the manual switch 10 caused the timer circuit 12 to output ON signal to change over the switching circuit 13 into ON state, so as to reserve the electric connection between the receiver 4 and the battery 5.

Figure 7:
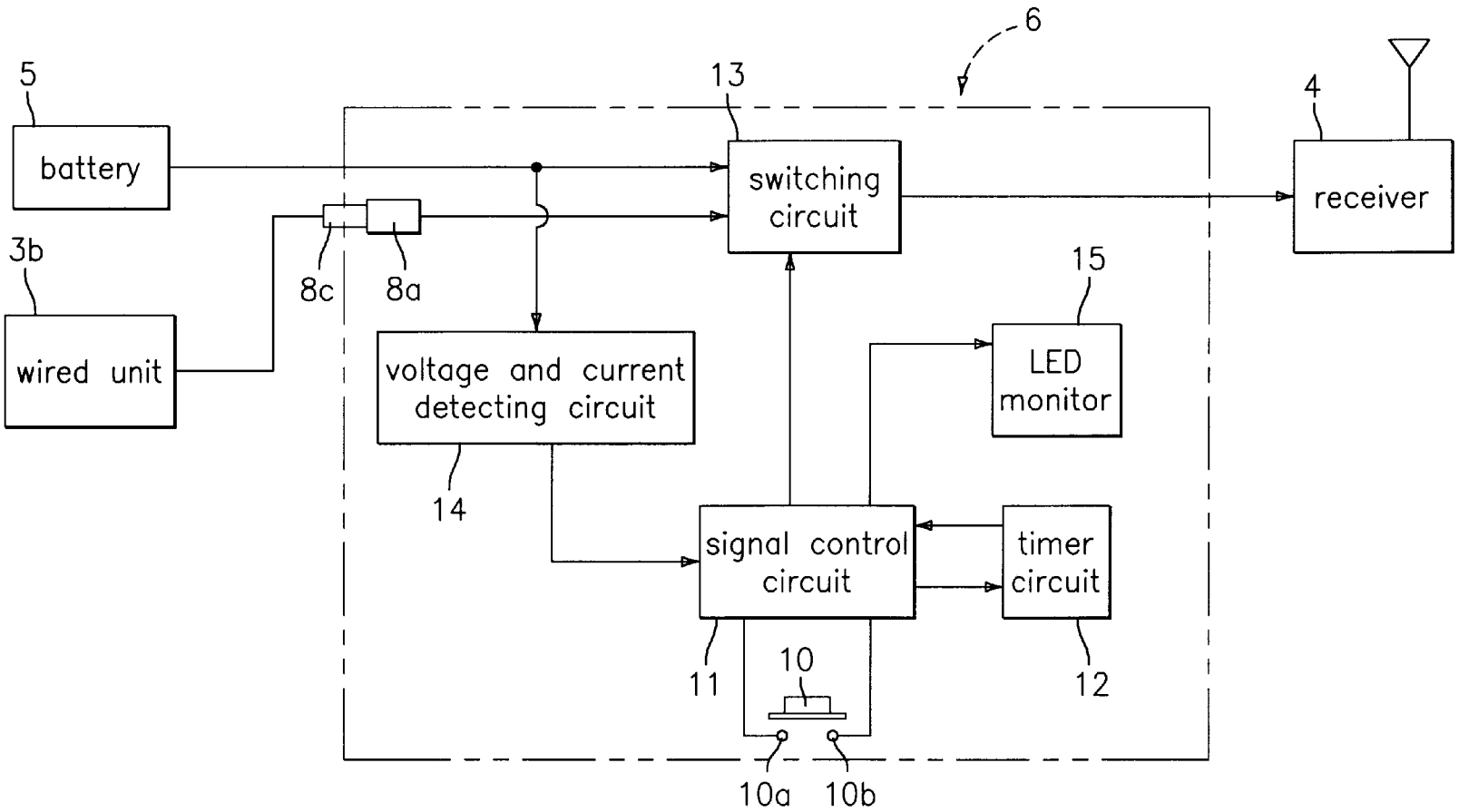
FIG. 7 is a block diagram showing a wired control state of the electronic switch means according to this invention.
Figure 8:
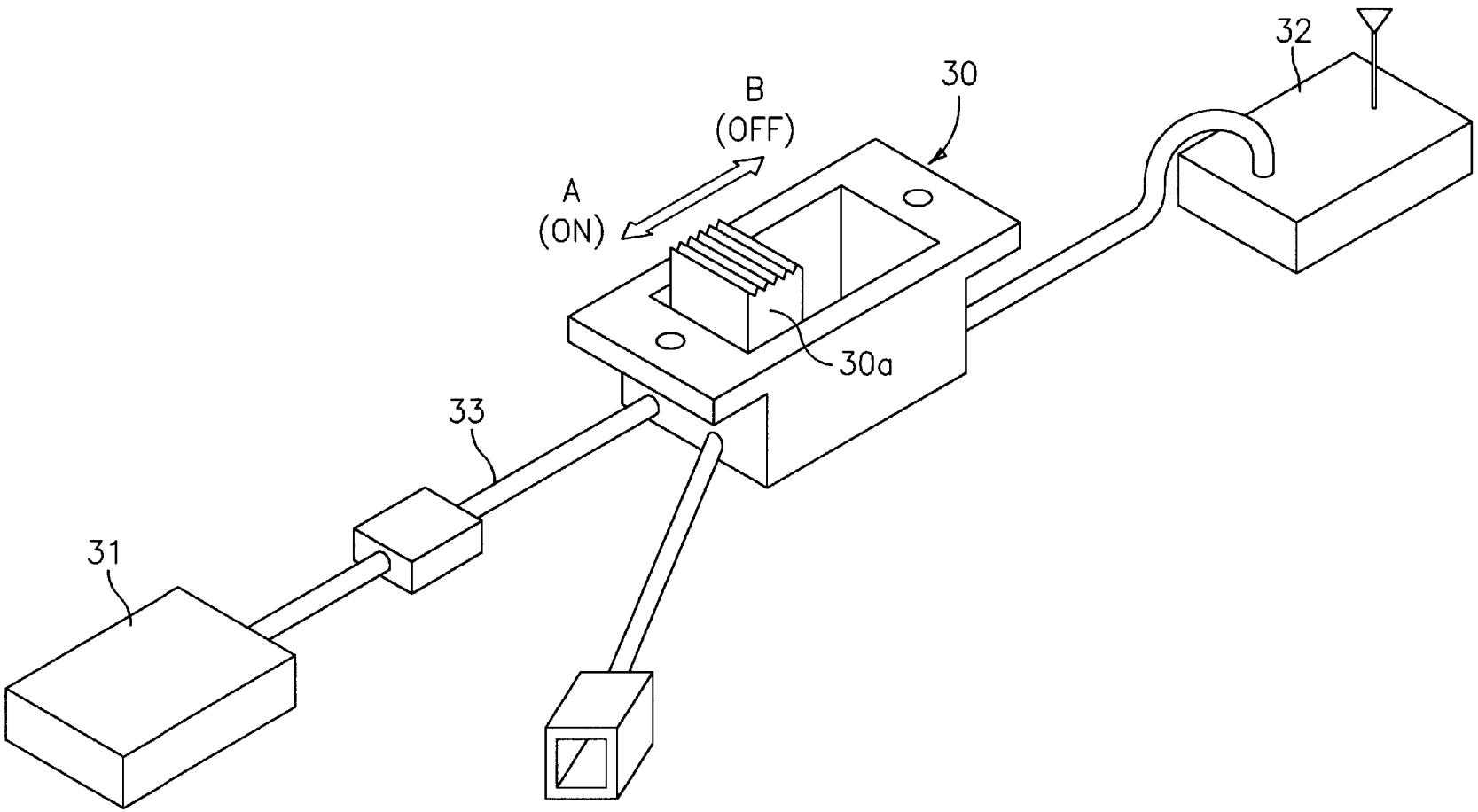
FIG. 8 (PRIOR ART)
FIG. 8 is a perspective view showing a conventional mechanical switch for the model car.

At this state, upon an operation of the transmitter 3, a signal to operate the model car 2 is fed to the receiver 4 from the wired unit 3*b* via the electronic switching means 6 (see FIG. 7).

Figure 6:
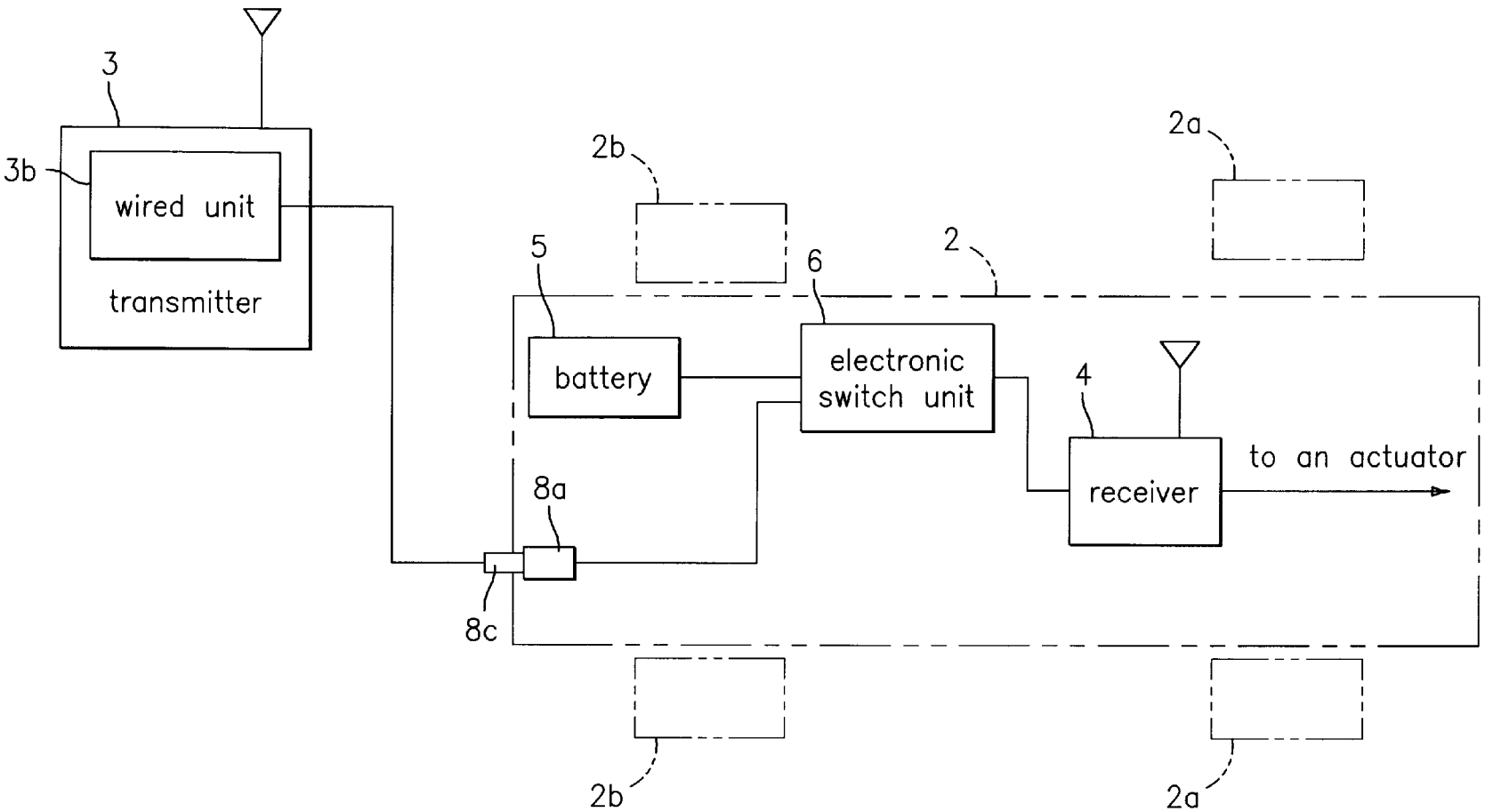
FIG. 6 is a block diagram showing a wired control state of the remote operation device employing the electronic switching means for the model according to this invention.

The receiver 4 receives a signal from the transmitter 3 and feeds an operation signal to the actuator of the model car 2, which permits the model car 2 shown in FIG. 6 to be controllably operated.

In the above embodiment mode, although a case that the LED monitor 15 shows the voltage drop state of the battery, other similar display means are selectively usable.

In the above embodiment mode, an example is explained wherein the electronic switch means for the model car along this invention is used for the model car, but it is usable to model planes, model helicopters and model boats.

As discussed above, a given period ON state maintenance of the manual switch permits the receiver and the battery to be ON state, and after a release of ON state of the manual switch to be OFF state for the time being, re-maintenance of the manual switch to be ON state for a given period can disconnect the electrical connection between the receiver and the battery.

Hence, even if the manual switch is changed over to OFF state unwillingly upon an abut of the manual switch to an obstacle during the run of the model car, there is no risk to disconnect the electric connection between the receiver and battery as far as a continuous given time OFF state is maintained.

In other words, there is no case generally to continue the state more than a given time when the manual switch abuts the obstacle temporarily during the run of the model car.

There is no case of incapability of remote operation unwillingly when the operator remote operates the model car.

Additionally, there is no anxiety of disconnection between the receiver and the battery caused by the vibration of the model.

The invention also permits an automatic change over of the switching circuit to OFF state based on the signal from the voltage and current detecting circuit, which prevents the flow of the over current during the charging into the receiver. Thus, as the operator needs not to change over often the manual switch at charging the battery, easy charging of the battery is achieved.

The invention permits a display of the battery voltage drop state by the display means at visible place of the electronic switch, which provides an easy judging of exchange time and charging time of the battery.

What is claimed is:

1. An electronic switch means having a receiver to receive signals from a transmitter and to output operation signals to an actuator of a model main body;

said switch means structured and arranged to change over an electric connection between said receiver to ON/OFF state;

a battery to apply voltage to said receiver;

a manual switch structured and arranged to be set to ON state by a depression of an operation button and to OFF state by releasing the depression of said operation button;

a switching circuit to be set in ON state to electrically connect the receiver and the battery, subject to maintenance of said manual switch in ON state for a given period by depressing said operation button;

said switching circuit being in OFF state to disconnect electrical connection between the receiver and the battery, subject to a release of the depression of said operation button to re-maintain the manual switch to be set in OFF state for a given period;

further comprising a voltage and current detecting circuit arranged to detect a voltage drop state and transmit a voltage drop signal to a signal control circuit which in turn transmits a signal to a display to illuminate the same and permit the operator to confirm the voltage drop of the battery; wherein said switching circuit is additionally structured and arranged for wired control operation by a separate wire unit which can be connected to said electronic switch means by coupling of respective male and female connectors, with a continuous given period depress of the operation button of said manual switch means arranged to cause a timer circuit to output an ON signal to change over said switching circuit to ON state so as to reserve electric connection between the receiver and the battery, and upon operation of the transmitter in this state, a signal to operate the model main body is fed to the receiver from said wired unit via the electronic switching means, and the receiver receives a signal from the transmitter and feeds an operation signal to an actuator of the model main body which permits the model main body to be controllably operated.

2. An electronic switch means for the model main body according to claim 1, where said voltage and current detecting circuit is also arranged to detect voltage rise state of the battery for charging, and charging current, during charging of said battery, and said switching circuit being changed over to be in OFF state, based on signals from said voltage and current detecting circuit.

3. An electronic switch means for the model main body according to claim 1, wherein said switching circuit is structured and arranged to couple a charger to the battery, whereby charging of the battery can take place, and said voltage and current detecting circuit is also arranged to detect charging current from the charger and a voltage rise at charging, and then transmit a cut signal to a signal control circuit which, in turn, feeds an OFF signal to the switching circuit based upon the cut signal, and the switching circuit automatically being changed over to OFF state, which causes electric connection between the receiver and the battery to be disconnected, so that an over current during charging does not flow into the receiver.

4. An electronic switch means for the model main body according to claim 1 which is structured and arranged to be remotely operated from a separate radio unit and transmitter by coupling of the battery and receiver in the model main body through the electronic switch means.

5. An electronic switch means for the model main body according to claim 1, wherein said operation button is structured and arranged such that upon depression of the same to the ON state, said button does not project out of the model main body.

6. An electronic switch means for the model main body according to claim 1, wherein said manual switch is placed in ON state by depressing the operation button and in OFF state by further depressing the operation button beyond the initial ON state depression, with said operation button being biased by a return spring.

7. The electronic switch means according to claim 6, wherein said manual switch is structured and arranged such that, upon release of depressing force towards said operation button, the operation button is returned such that the manual switch itself is changed over automatically to the OFF state, however, said electronic switch circuit maintains electrical connection between the receiver and battery, such that the ON state is maintained in the circuitry, even if the manual switch is changed over to OFF state.

* * * * *